US012331511B2

(12) United States Patent
Headley

(10) Patent No.: US 12,331,511 B2
(45) **Date of Patent: *Jun. 17, 2025**

(54) APPARATUS AND SYSTEM FOR ACOUSTIC CURVED CEILING BAFFLE AND METHODS OF MANUFACTURING THEREOF

(71) Applicant: TURF DESIGN, INC., Gilberts, IL (US)

(72) Inventor: Dustin Headley, Hoffman Estates, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/231,903

(22) Filed: Aug. 9, 2023

(65) Prior Publication Data

US 2023/0383532 A1 Nov. 30, 2023

Related U.S. Application Data

(63) Continuation of application No. 16/997,561, filed on Aug. 19, 2020, now Pat. No. 11,732,471.

(60) Provisional application No. 62/888,593, filed on Aug. 19, 2019.

(51) Int. Cl.

| | |
|---|---|
| ***E04B 1/86*** | (2006.01) |
| ***E04B 1/99*** | (2006.01) |
| *E04B 1/84* | (2006.01) |

(52) U.S. Cl.

CPC ..... *E04B 1/99* (2013.01); *E04B 2001/8414* (2013.01); *E04B 1/86* (2013.01); *E04B 2103/04* (2013.01)

(58) Field of Classification Search

CPC ..... E04B 1/86; E04B 1/99; E04B 1/18209; E04B 1/8404; E04B 1/8409; E04B 2001/8263; E04B 2001/8414; E04B 2001/8476; E04B 9/001

USPC ..... 52/144

See application file for complete search history.

(56) References Cited

U.S. PATENT DOCUMENTS

| | | | | |
|---|---|---|---|---|
| 2,542,428 | A * | 2/1951 | Peik | E04B 1/86 181/290 |
| 4,441,581 | A * | 4/1984 | Sommerhalder | E04B 1/86 181/290 |
| 4,471,596 | A * | 9/1984 | Deaton | F21V 11/06 362/319 |
| 4,480,715 | A * | 11/1984 | Brooks | E04B 2/7429 428/167 |
| 5,009,043 | A * | 4/1991 | Kurrasch | E04B 1/8227 181/290 |
| 5,923,002 | A * | 7/1999 | McGrath | E04B 1/82 181/290 |
| 6,305,492 | B1 * | 10/2001 | Oleiko | E01F 8/0017 181/210 |
| 8,782,987 | B2 | 7/2014 | Kabatsi et al. | |
| 9,779,715 | B1 * | 10/2017 | Seldal | G10K 11/162 |
| 10,094,108 | B2 * | 10/2018 | Murao | E04B 9/0428 |
| 10,508,444 | B2 | 12/2019 | Gillette et al. | |
| 10,584,488 | B2 | 3/2020 | Gillette et al. | |

(Continued)

*Primary Examiner* — Kyle J. Walraed-Sullivan
(74) *Attorney, Agent, or Firm* — Patrick Sheldrake

(57) ABSTRACT

An acoustic curved ceiling baffle and system that incorporates sidewalls with cuts or kerfs, top and bottom spines and ribs to properly configure the curves in the acoustic baffle, and that can be quickly and easily installed onto ceilings using integrated locks, cables or magnets, to produce a curved baffle system, and to provide an aesthetically pleasing image, along with a reduction in unwanted noise and/or room acoustics.

21 Claims, 6 Drawing Sheets

(56) References Cited

U.S. PATENT DOCUMENTS

| | | | | |
|---|---|---|---|---|
| 11,434,636 | B2 | 9/2022 | Headley et al. | |
| 2005/0011150 | A1 | 1/2005 | Stackenwalt et al. | |
| 2006/0166581 | A1* | 7/2006 | Huang | E04B 1/74 442/181 |
| 2013/0251935 | A1* | 9/2013 | Day | B32B 5/24 428/71 |
| 2014/0224570 | A1* | 8/2014 | Dupuy | G10K 11/28 181/175 |
| 2014/0262607 | A1* | 9/2014 | Gray | E04B 1/84 181/290 |
| 2016/0138259 | A1* | 5/2016 | Hauptman | E04B 9/0407 52/80.2 |
| 2016/0281353 | A1* | 9/2016 | Gillette | G10K 11/162 |
| 2017/0044761 | A1* | 2/2017 | Flotre | G10K 11/162 |
| 2017/0107718 | A1* | 4/2017 | Sato | E04C 2/243 |
| 2018/0283004 | A1* | 10/2018 | Gillette | E04B 9/366 |
| 2018/0363558 | A1* | 12/2018 | Weaver | F02C 7/045 |
| 2019/0106883 | A1* | 4/2019 | Moore | E04B 9/366 |
| 2019/0127972 | A1* | 5/2019 | Mackett | E04B 1/86 |
| 2019/0292774 | A1* | 9/2019 | Durali | E04B 1/994 |
| 2022/0246125 | A1 | 8/2022 | Headley | |
| 2022/0246126 | A1 | 8/2022 | Headley | |
| 2022/0299977 | A1 | 9/2022 | Headley et al. | |

* cited by examiner

APPARATUS AND SYSTEM FOR ACOUSTIC CURVED CEILING BAFFLE AND METHODS OF MANUFACTURING THEREOF

The present application claims priority to U.S. patent application Ser. No. 16/997,561, filed Aug. 19, 2020, now U.S. Pat. No. 11,732,471, issued Aug. 22, 2023, and U.S. Provisional Patent Application Ser. No. 62/888,593, filed Aug. 19, 2019, entitled "APPARATUS AND SYSTEM FOR ACOUSTIC CURVED CEILING BAFFLE AND METHODS OF MANUFACTURING THEREOF", all of which are hereby incorporated by reference in their entirety.

BACKGROUND a. Technical Field

The instant disclosure relates to acoustic curved ceiling baffles and systems, along with the methods for manufacturing and installing the acoustic curved ceiling baffles. In particular, the instant disclosure relates to an acoustic curved ceiling baffles and systems that incorporate cuts or kerfs to properly configure the curves in the acoustic baffle, and that can be quickly and easily installed onto construction ceiling hangers using integrated locks, cables or magnets, to produce a curved baffle system, and to provide an aesthetically pleasing image, along with a reduction in unwanted noise and/or room acoustics.

The instant disclosure further relates to an acoustic baffle and system configured using a program that calculates the correct location of the kerfs in the sidewalls to optimize the predetermined curved baffle pattern or design. Once the sidewalls of the curved baffle are created and assembled along with the top and bottom shaped portions or sections, the assembly will then include an air gap for optimal acoustic properties. The top and bottom shaped portions may include ribs, stiffeners or struts to hold the sidewalls in place and in formation.

The instant disclosure further relates to an apparatus that is configured using recycled polyester felt or PET Felt, and in the preferred embodiment, including the sidewalls, top and bottom shaped portions and the struts. Additionally, the sidewalls may be covered by another layer of felt (or other material) to hide the kerfs incorporated to create the curved baffle.

Although felt or PET Felt is the preferred material due to acoustic, weight and environmental aspects, the instant disclosure can incorporate any material in the manufacture of the acoustic curved baffle, including plastic, wood, metal, etc. The acoustic curved baffle design can also incorporate numerous materials in the same design. For example, the sidewalls could be manufactured using PET Felt and the cover of the walls could be a thin layer of wood. Other possibilities exist for mixing materials.

b. Background of Disclosure

In general, terms, ceilings can be of two different types, suspended or exposed. Suspended ceilings are usually hung at a distance below the structural members to hide mechanical and electrical equipment, along with electrical conduit, HVAC ducts, water pipes, sewage lines, lighting fixtures, and similar structures. In order to construct a suspended ceiling, a metal grid is suspended from the actual ceiling, usually by wires, and acoustical or similar tiles, are inserted and supported by the grid.

However, for either cost or design purposes, many designs provide that the mechanical and electrical equipment are to be seen and not hidden. In these designs, there is no dropped ceiling and the ceiling is left to be viewed from the floor. Although the exposed ceiling may be a function of the design appeal, quite often an exposed ceiling creates acoustic problems, especially in large industrial rooms. Sound from one area of the room, can be reflected off the ceiling and be heard in other areas of the room. If there are a lot of workers or machinery, the room can become quite loud.

In order to minimize excessive and/or unwanted sound generated because of the exposed ceiling, one solution is to hang baffles from the ceiling at certain intervals to allow for the exposed ceiling to be viewed, but to reduce the acoustic profile. As an example of a structure intended to reduce unwanted noise is the Supported Architectural Structure disclosed and claimed in U.S. Pat. No. 8,782,987, to Kabatsi et al., which discloses a plurality of primary supports configured to couple with one or more architectural structures, and a plurality of flexible fins is incorporated into the structure using primary supports, secondary supports and attachment points.

Another example of a ceiling structure is U.S. patent application Ser. No. 10/774,233, to Stackenwalt et al., which discloses a decorative structure, which may be curved, suspended within a space and which includes a panel fastened to a support structure by a clip, a portion of which extends along a face of the panel.

These examples utilize additional supports, attachment hardware and clips to assist in suspending the flexible fins or decorative panels to the ceiling or to ceiling structure. In doing so, each of these examples necessitate tools to assemble the structure and to suspend the structure to the ceiling or ceiling support structure.

As such, there is a need for an acoustic ceiling baffles and systems that include curved baffles that look solid, but have an air core or are hollow to provide beneficial acoustic properties. There is also a need for these baffles and systems to be configured to be quickly and easily installed onto existing construction ceiling hangers or support structures, in many cases, without the need for tools, separate attachment devices, clips or the like. There is also a need for an acoustic curved ceiling system that is an aesthetically pleasing image, and that reduces unwanted noise or room acoustics.

The foregoing is intended only to illustrate the present technical field and background art and should not be taken as a limitation or disavowal of claim scope.

BRIEF SUMMARY

The present disclosure is an improved acoustic curved ceiling baffle that utilizes kerfs in the sidewalls to facilitate the creation of the curvature of the sidewalls into the desired curved shape. The curved base sides are configured to be quickly and easily installed onto construction ceiling hangers using either integrated locks, cables or magnets (or a combination of these methods), to produce a curved baffle system, and to provide an aesthetically pleasing image, along with a reduction in unwanted noise and/or room acoustics. The installation methods are described in detail in U.S. patent application Ser. No. 15/639,638, incorporated by reference herein.

The instant disclosure further relates to program used to create the acoustic curved baffle designs. The system uses a program that determines or calculates the location of the kerfs in the sidewalls to optimize the predetermined curved baffle pattern or design. The program can determine where the kerfs should be located in the sidewalls to allow the material to curve either in a concave or convex direction. The program can also determine the size of the particular kerfs depending on the radius of curvature of the sidewalls, or if there is no need for a kerf, such as a straight section of the sidewall. Additionally, the program can determine where a strut will be located on the top or bottom portion or spine, and provide for a cut away of the sidewall at the proper location and in the correct direction, as the strut may intersect the sidewall at a curved portion.

In use, the program can accept a curved design input, possibly from the information pertaining to the top and/or bottom shaped spine. The top and bottom shaped spines may include ribs, stiffeners or struts to hold the sidewalls in place and in formation. If so, the information provided to the program may also include where the struts or ribs of the spine will be located. Using that information, the program can calculate or determine the specific location and size of the kerfs necessary to be cut into the sidewalls to facilitate the creation or manufacture of the sidewalls of the curved baffle. The program can also calculate where the struts will intersect the sidewalls (and the direction of intersection) and provide for cut out of the material at those locations.

Once the program has determined where the kerfs and the strut cutouts are to be located on the sidewalls and the correct kerf sizes for proper curvature, a computer numeric control or CNC machine can cut the kerfs out of the material to create the sidewalls. The CNC machine can also cut out the material for the struts to be located.

Once the sidewalls of the curved baffle with the kerfs and cutouts are created along with the top and bottom spines or shaped portions, the curved baffle can be assembled. The sidewalls will easily curve at the kerfs and fit into the struts of the top and bottom spines. The assembly will then include an air gap for optimal acoustic properties. The top side and bottom side further keep the two base sides a distance apart to create the air gap, which contributes to the beneficial acoustic properties.

Once the sidewalls and top and bottom spines are assembled together, the curved baffle can be finished for a desired look and for installation purposes. For example, the sidewalls and the top and bottom spines can be covered with a similar but thinner material to make the entire curved baffle monochromatic. Additionally, installation hardware can be installed to allow the curved baffle to be installed onto the ceiling structure. For example, cable connectors can be installed into the top spine so that the curved baffle can be attached to hanging cables at the installation site.

The instant disclosure further relates to an apparatus that is configured using recyclable or recycled polyester felt or PET Felt, in the preferred embodiment, including the sidewalls, top and bottom shaped portions and the ribs or struts. Again, the sidewalls may be covered by another layer of felt to hide the kerfs incorporated to create the curved baffle. In the preferred embodiment, PET Felt having a thickness of nine (9) millimeters is used for the sidewalls, top and bottom portions, and the struts or ribs. Additionally, PET Felt having a thickness of three (3) millimeters is used for the material covering the sidewalls and the bottom and top portions to give the end product a finished look.

Although felt or PET Felt is the preferred material due to acoustic, weight and environmental aspects, any material can be used to manufacture the acoustic curved baffle of the present invention, including plastic, wood, metal, etc. The acoustic curved baffle design can also incorporate numerous materials in the same design. For example, the sidewalls could be manufactured using PET Felt and the cover of the walls could be a thin layer of wood. Other possibilities exist for mixing materials.

It is thus an objective of the present disclosure to provide an improved acoustic curved baffle, comprising sidewalls with kerfs for facilitating the curvature of the baffle sides, along with a top and bottom spines containing ribs to facilitate the assembly of the baffle. An objective of the present disclosure further provides for the sidewalls and the top and bottom spines to be covered using a thin veneer, laminate or material to improve the visual characteristics of the baffle. Additionally, an objective of the present disclosure provides for installation hardware to be attached to the curved baffle to facilitate installation onto existing ceiling structures without the need for tools, clips or additional attachment devices.

It is yet another objective of the present disclosure to provide a program for calculating and determining the placement or location of the kerfs and cutouts in the sidewalls and the shape of the top and bottom spines based on the curved baffle design. Once determined, it is an objective of the present disclosure to provide instructions to a CNC machine for cutting out the sidewalls, top and bottom spines and the ribs, along with the kerfs properly located on the sidewalls for the particular curved design.

Additional objectives and advantages of the present disclosure will become apparent to one having ordinary skill in the art after reading the specification in light of the drawing figures, however, the spirit and scope of the present invention should not be limited to the description of the embodiments contained herein.

DETAILED DESCRIPTION

As stated herein, the objective of the present disclosure is to provide an improved acoustic curved ceiling baffle, and an improved acoustic curved ceiling system, along with improved methods for manufacturing and installing the curved ceiling baffles and creating the acoustic curved ceiling system.

Figure 1:
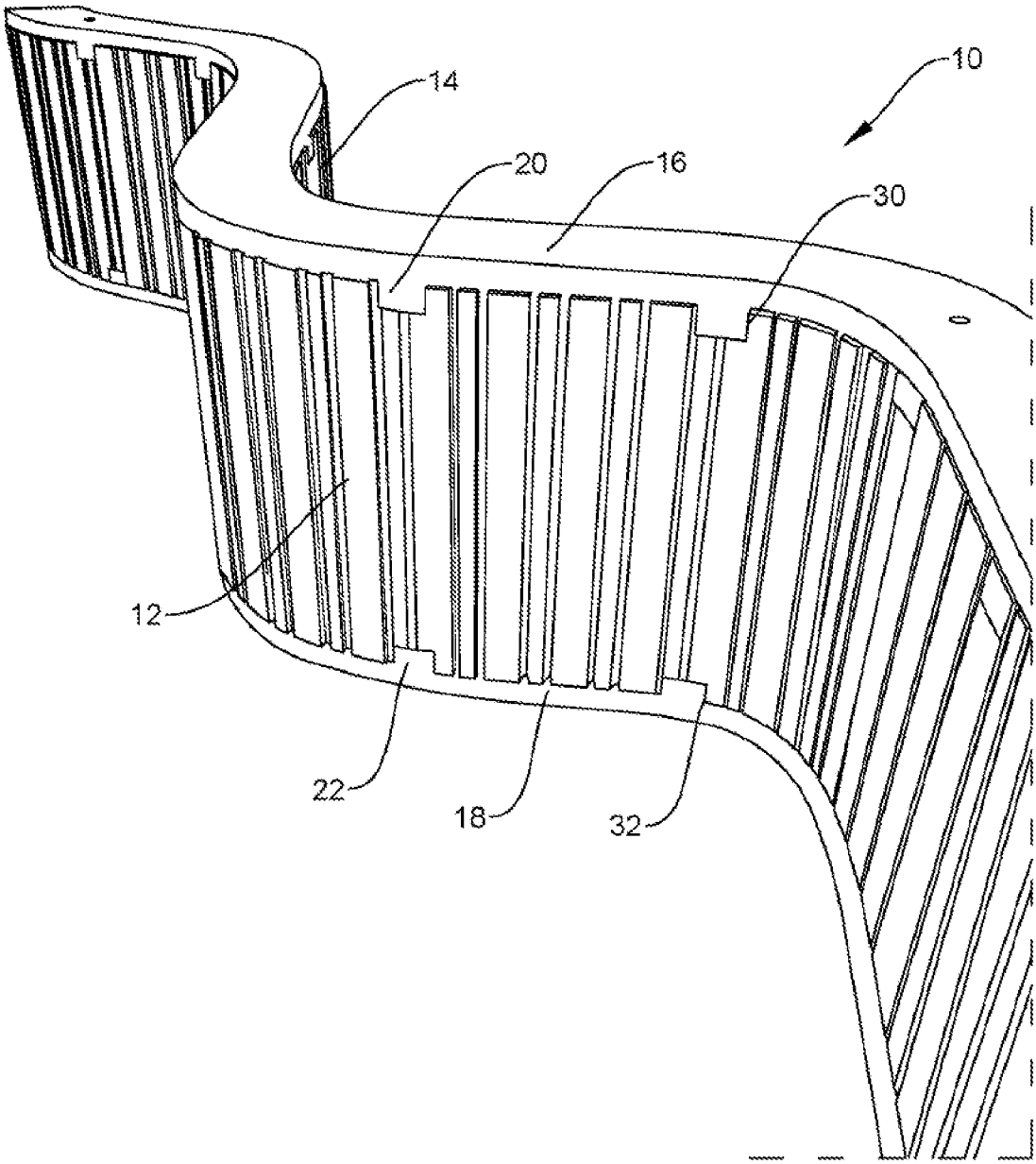
FIG. 1 is a perspective view of an acoustic curved ceiling baffle in accordance with the present disclosure.

Referring to the drawings, wherein like reference numerals refer to the same or similar features in the various views, FIGS. 1 through 8 show different views of the improved curved baffle 10. FIG. 1 shows the resulting curved baffle 10 after the first sidewall 12 and second sidewall 14 are assembled with the top spine 16 and bottom spine 18. The top spine 16 contains one or more top spine struts or ribs 20, and the bottom spine comprises one or more bottom spine struts or ribs 22. Theses struts 20, 22 are used in conjunction with the top spine 16 and bottom spine 18 to hold the sidewalls 12, 14 in place in their curved position. This assembly creates an air gap 24 (see FIG. 3), which creates the acoustic curved baffle of the present invention.

The curved baffle 10, which is made in the preferred embodiment, from sheets of nine (9) millimeter polyester felt or PET Felt, is intended to be assembled into a rectangular shape, approximately 8.25 inches high and 2.0 inches thick with an air gap of 1.06 inches. Of course, varying lengths, heights and depths are possible depending on the curvature design. Curved baffles as large as ten feet long and four feet high can be incorporated using the functionality described herein. PET Felt is used in the preferred embodiment due to its beneficial acoustic, weight and environmental properties.

However, almost any material can be used to produce the sidewalls 12, 14, top 16 and bottom 18 spines and the struts 20, 22. Thus, the acoustic curved baffle of the present invention can be manufactured out of plastic, wood, metal, and other materials. Additionally, the acoustic curved baffle design can incorporate different materials in the same design, such as sidewalls 12, 14 of PET Felt, to and bottom spines 16, 18 made of wood and struts 20, 22 made of plastic, as an example. Other possibilities exist for mixing materials.

Figure 2:
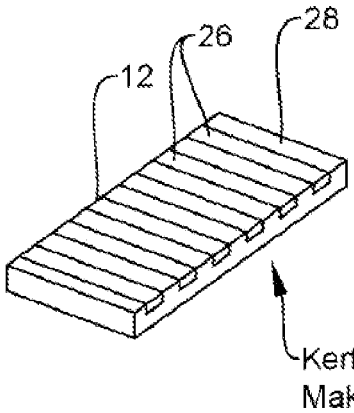
FIG. 2 is a perspective view of a sidewall of an acoustic curved ceiling baffle after kerfs before curvature of the sidewall in accordance with the present disclosure.

FIG. 2 shows the first sidewall 12 in its flat position before it is assembled in its curved position. The sidewall 12 has been modified to include kerfs or cuts 26 in a first side 28 of the sidewall 12. The kerfs 26 can be straight creating square or rectangular cuts into the first side 28 of the sidewall 12. Additionally, the kerfs 26 can be angled creating an upside down triangle cuts into the first side 28 of the sidewall 12. Either way, the kerfs 26 configured in the sidewall 12 facilitate the flex or curvature of the sidewall 12 in either the concave or the convex direction. The kerfs 26 can be the same size, or different sizes, as different size kerfs 26 will allow for smaller diameter curves. Also, to the extent the curved baffle 10 design is straight in a section of the baffle 10, there may not be a need for a kerf 26 to be cut into the sidewall 12 at that location.

Figure 3:
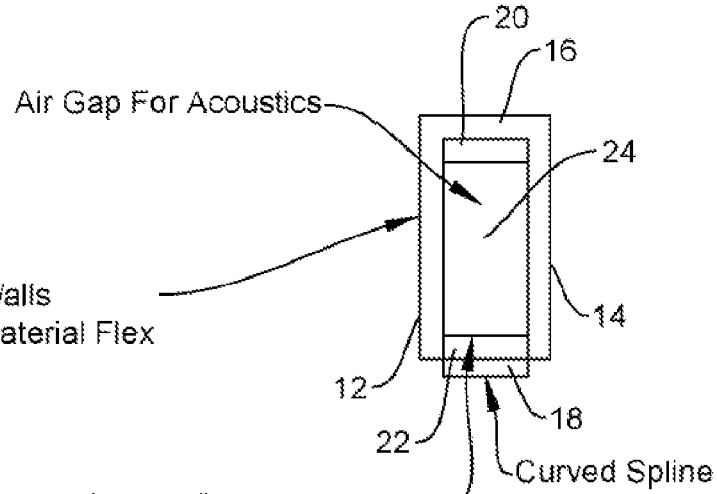
FIG. 3 is a side view of an acoustic curved ceiling baffle in accordance with the present disclosure.

FIG. 3 shows a side view of a cut away from the middle of the curved baffle 10. The cutaway shows the first sidewall 12 and second sidewall 14, after being assembled with the top spine 16 and bottom spine 18. The top spine struts 20 and the bottom spine struts 22 fit into the top cut outs 30 and bottom cut outs 32, respectively, as shown in FIG. 1. Theses struts 20, 22 assist in securing the sidewalls 12, 14 in place in their curved position. The air gap 24 creates the acoustic properties of the curved baffle.

Figure 4:
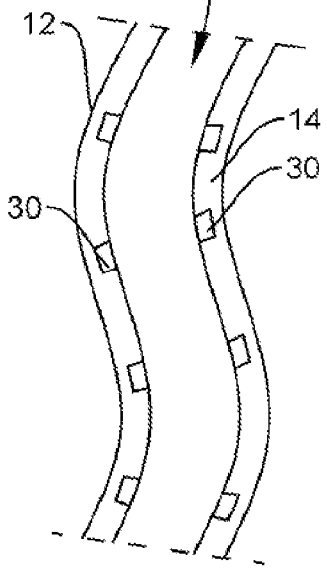
FIG. 4 is a top view of an acoustic curved ceiling baffle without the top spine in accordance with the present disclosure.

FIG. 4 shows a top view of the acoustic curved baffle 10 without the top spine 16, which includes the first sidewall 12 and the second sidewall 14 along with the cutouts 30 in the sidewalls 12, 14 that are used to receive or guide the top spine 16 struts 20. When the struts or ribs 20 of the top spine 16 are inserted into the top cutouts 30, the sidewalls 12, 14 will maintain their curved shape. Maintaining the curved shape is also helped by the insertion of the struts or ribs 22 of the bottom spine 18 into the bottom cutouts 32 of the sidewalls 12, 14 (see FIG. 1).

Figure 5:
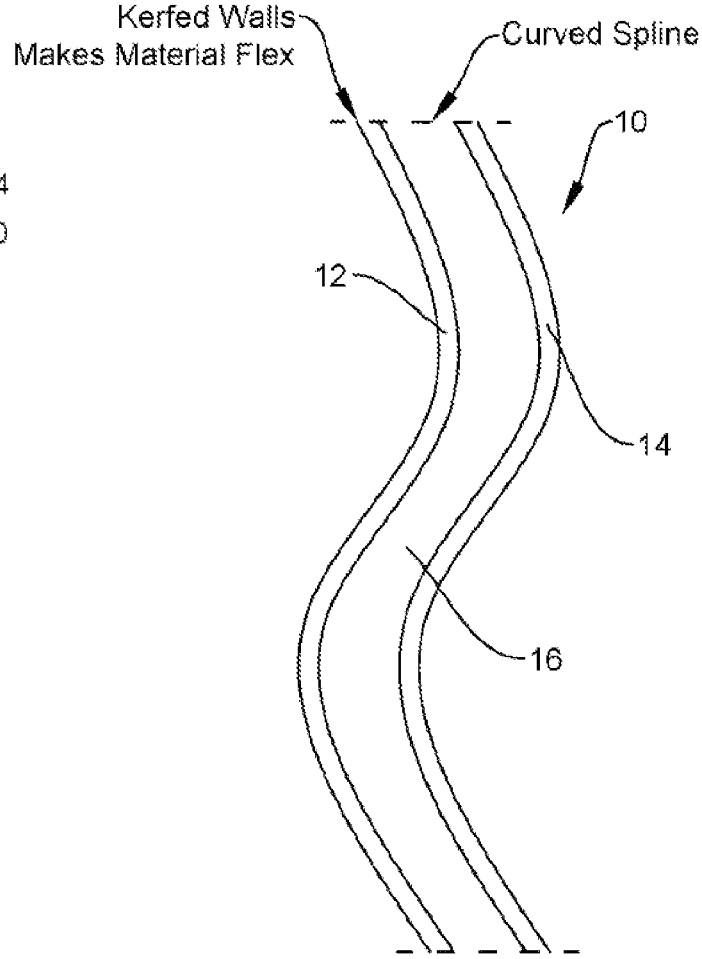
FIG. 5 is a top view of an acoustic curved ceiling baffle in accordance with the present disclosure.

Once the struts 20 of the top spine 16 are inserted into the top cutouts 30 of the sidewalls 12, 14, the curved baffle will maintain its shape. FIG. 5 shows a top view of the acoustic curved baffle 10 with the curved top spine 16 placed over the first sidewall 12 and the second sidewall 14.

Figure 6:
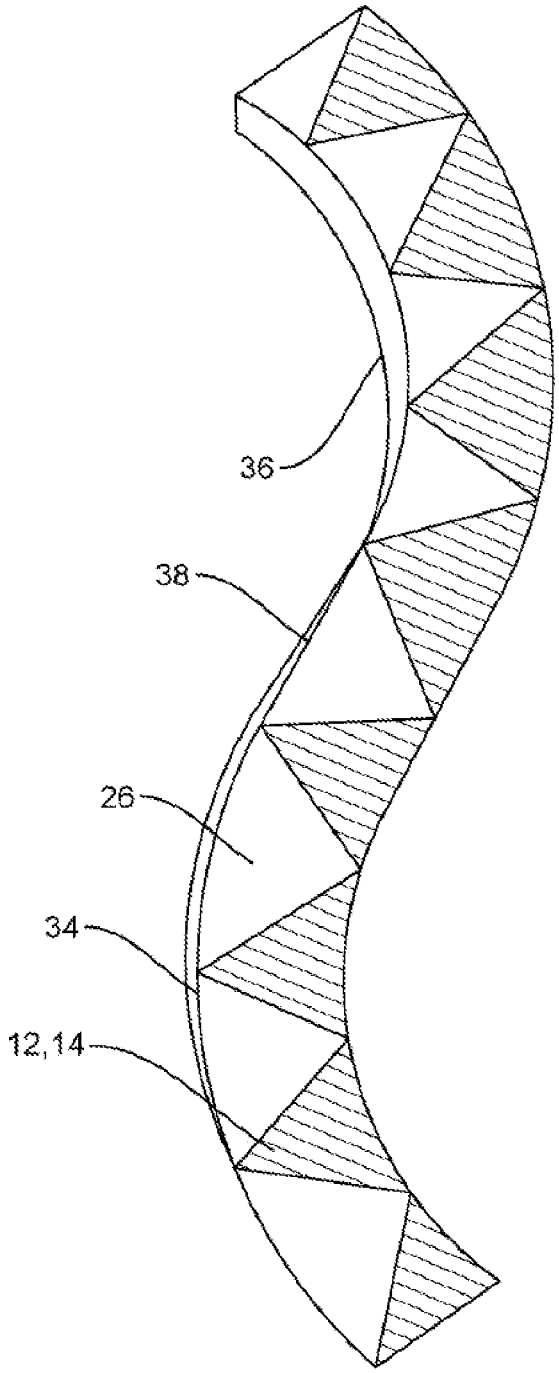
FIG. 6 is a top view of a sidewall of an acoustic curved ceiling baffle after kerfs after curvature of the sidewall in accordance with the present disclosure.

FIG. 6 is a top view of a sidewall 12, 14 of the acoustic curved baffle 10, either the first sidewall 12 or the second sidewall 14, after kerfs 26 have been cut into the sidewall 12, 14 and after curvature of the sidewall 12, 14. In the FIG. 6 example, the sidewall 12, 14 is able to curve in both convex 34 and concave 36 patterns from the front side 28 of the sidewall 12, 14. Depending on the size and location of the kerfs 26, the curvature can be a smaller sharp radius or a larger more gradual radius.

To the extent that the design calls for covering up the kerfs 26 on the sidewall 12, 14, to create a smoother outer surface, a layer of material 38 can be installed or attached to the front side 28 of the sidewall 12, 14. Again, this can be almost any material, such as wood, plastic or metal, but in the preferred embodiment, a three (3) millimeter thick PET Felt piece 38 is attached to the front side 28 of the sidewall 12, 14. Other sizes and materials can be used for the device cover.

Figure 7:
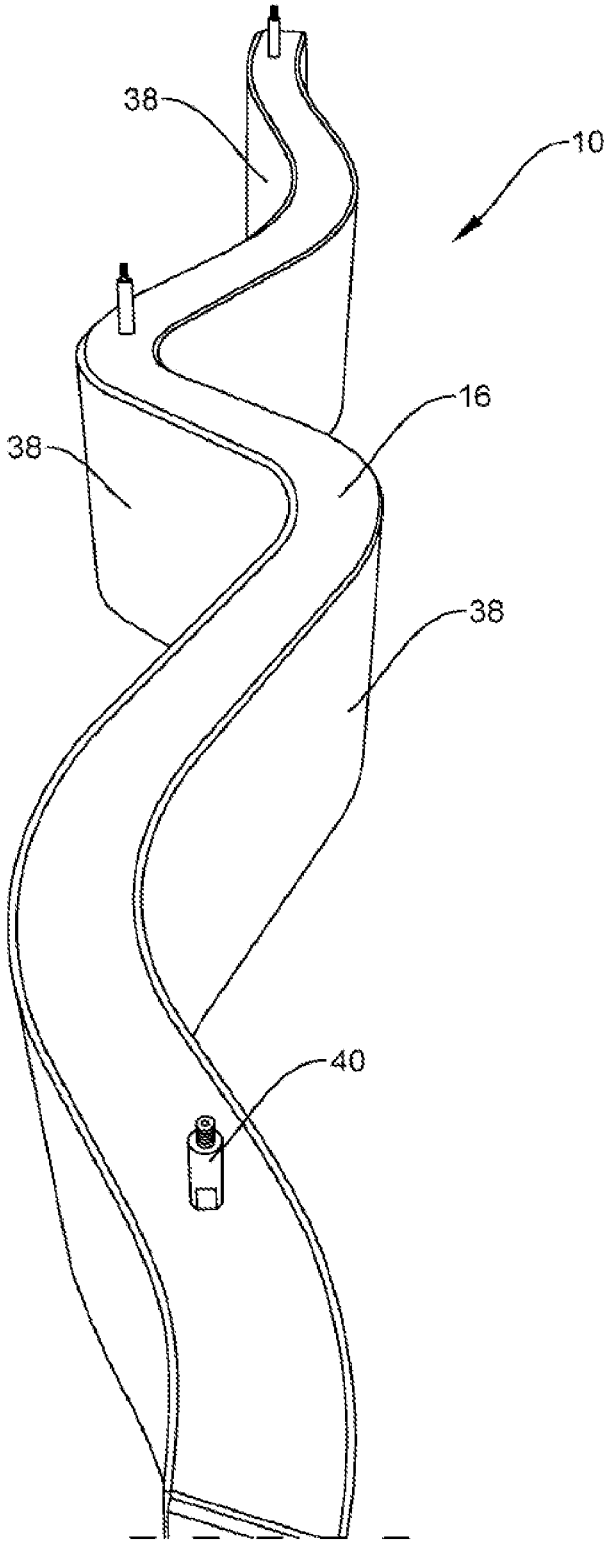
FIG. 7 is a perspective view of an acoustic curved ceiling baffle in accordance with the present disclosure.
Figure 8:
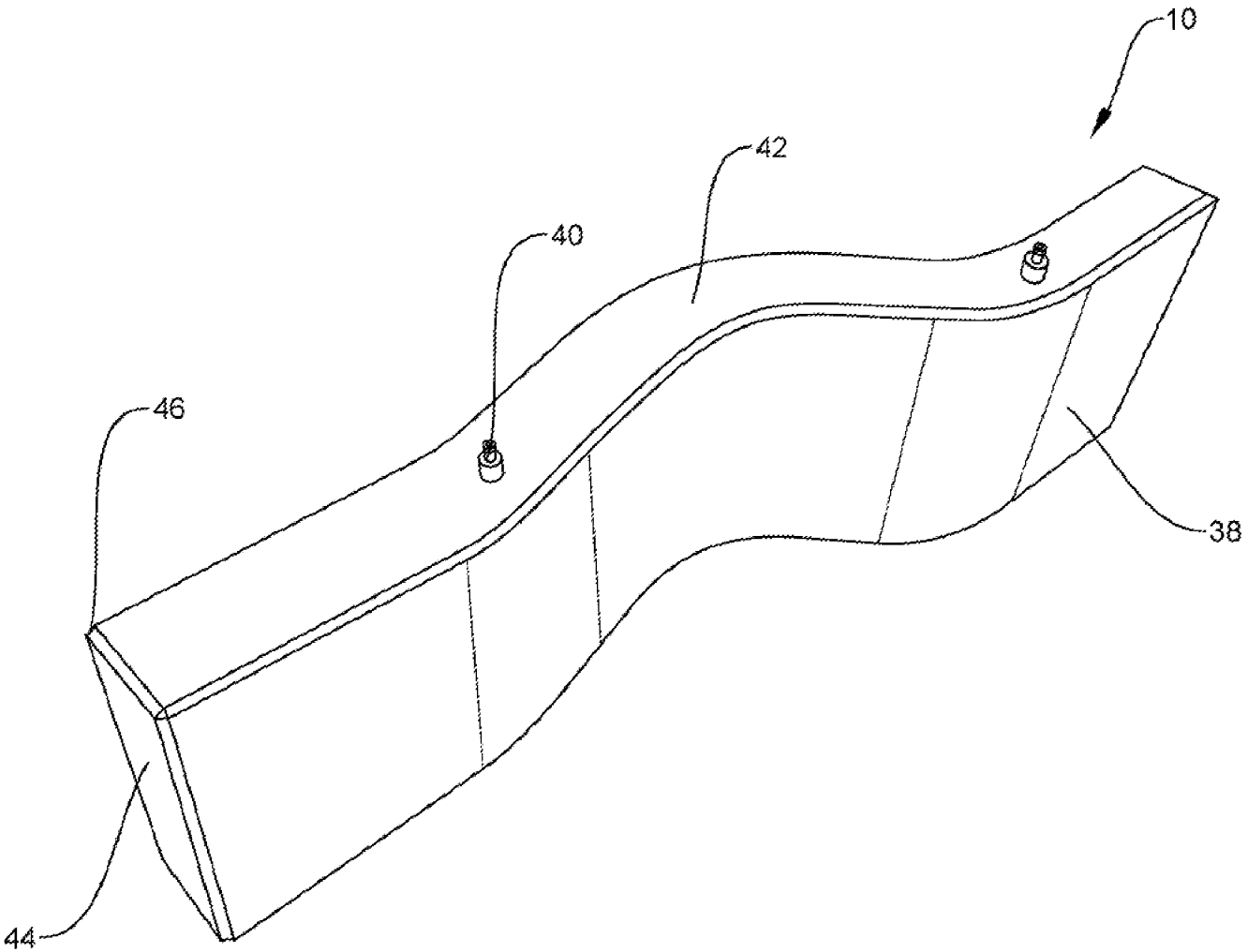
FIG. 8 is a perspective view of an acoustic curved ceiling baffle in accordance with the present disclosure.

FIGS. 7 and 8 show the acoustic curved ceiling baffle 10 after being assembled in the curved position of the intended design. FIG. 7 shows the top spine 16 and the sidewalls 12, 14, which are concealed by a cover 38. The installation hardware 40 is included to allow the installation of the curved baffle 10 onto a ceiling system (not shown). In FIGS. 7 and 8, the installation hardware will be attached to cables hanging from the ceiling. FIG. 8, like FIG. 7, includes a cover 38 over the sidewalls 12, 14, but also includes a top cover 42 over the top spine portion 16. Additionally, FIG. 8 shows end covers 44 that are located at the ends 46 of the acoustic curved baffle 10. These covers 38, 42, 44 provide a streamlined, monochromatic vision, although any type of cover 38, 42, 44 and color can be achieved.

Numerous ceiling baffle shapes and designs can be constructed in accordance with the present disclosure. The curved portions 12, 14 that will be assembled to make the curved baffle 10 can use almost any concave or convex design imaginable. The top 16 and bottom 18 spines will then be created along with the struts 20, 22 so that the curved baffle 10 can be assembled accordingly.

By using a program, as detailed below, the proper kerf 26 size and location can be calculated to be carved out in the sidewalls 12, 14, along with the top and bottom spines 16, 18 and the struts 20, 22. Once all the pieces are known and/or calculated, the program can determine the optimal cut design thereby reducing material waste. Once the program is converted for use with a CNC machine, the CNC machine can cut each of the pieces necessary for the curved baffle 10. As such, using the program and a CNC machine, a user can design a baffle and have the structural pieces cut out in a very short time.

As described herein, the material used in the preferred embodiment is polyester felt and is between 60% and 99% recycled material. The walls of the acoustic curved ceiling baffles 10 in the preferred embodiment are 9 mm thick, and the panel thickness (after assembly) is 2.0 inches thick, with an air gap of 1.06 inches. Other sizes are possible. Maintenance includes occasional vacuuming to remove particulate matter and air-borne debris or dust. Compressed air can be used to dust off the material in difficult to reach areas and for large assemblies.

The felt comes in numerous colors, including white, cream, light grey, light brown, brown, matte grey, charcoal, black, yellow, mango, orange, red, lavender, lime, green, light blue and dark blue. Of course, the curved ceiling baffles 10 can be manufactured in many other colors and the present disclosure is not limited to these specifications and colors, as these are merely the specifications and colors for the preferred embodiments and alternative embodiments.

An alternative embodiment for installing the curved baffle 10 includes using magnets 40 embedded into the curved baffle 10 so that when the curved baffle 10 is assembled, the embedded magnets will hold the curved baffle 10 to a standard ceiling structure (not shown) or to any metal material.

Figure 9:
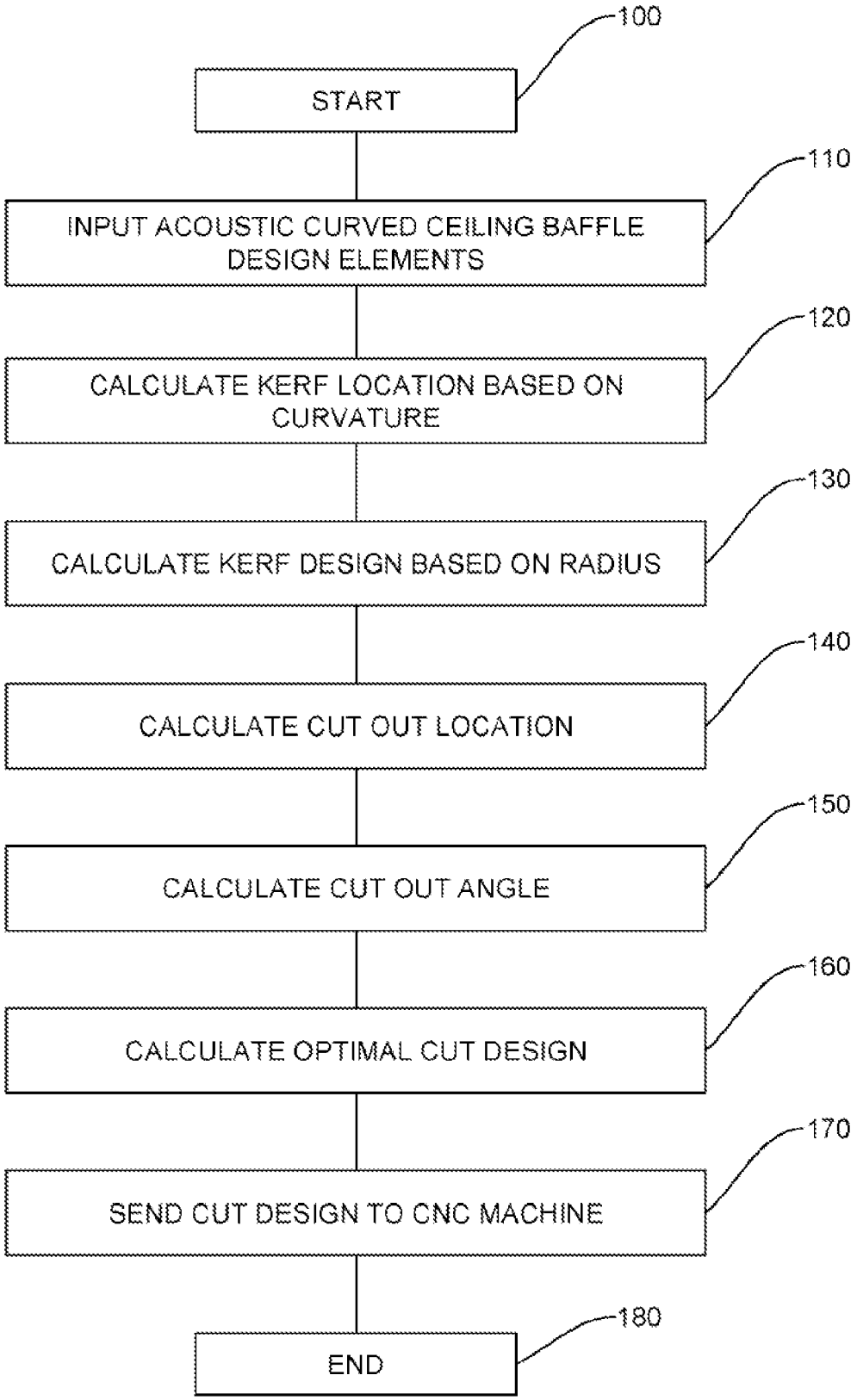
FIG. 9 is a flow chart of the program to calculate the kerfs and cut outs for the sidewalls in accordance with the present disclosure.

FIG. 9 shows a flow chart of the program used to calculate the kerfs and cut outs for the sidewalls, along with the information for all pieces as sent to a CNC machine for optimal cutting and scoring. The program starts at step 100, which is the same as all programming functions. At step 110, the acoustic curved ceiling baffle 10 is designed and/or entered into the computer system. This can be done in a number of ways, including providing CAD/CAM software so that the user can design a curved baffle 10, or if the curved baffle 10 has already been designed, entering the information into the system for calculations and determinations.

Once the curved baffle 10 design has been generated and entered into the computer system, the system calculates the kerf 26 locations in step 120. These kerf 26 locations will be based on the baffle 10 design and the curvature of the design. Along those lines, at step 130, the program will calculate or determine the size of the individual kerfs 26. For example, if the curvature is very tight, a small radius, the program may us larger kerfs 26 and closer together, to allow a small radius curve. If the radius is large, the sidewall 12, 14 may only need a couple, smaller kerfs 26 to obtain the correct radius of curvature.

Once the kerf 26 determination has been completed, the program can calculate the cut out angles and locations 30, 32 in the sidewalls 12, 14 for the struts 20, 22 to be inserted. These struts 20, 22 will secure the top and bottom spines 16, 18 to the sidewalls 12, 14. This includes step 140, determining the location, and step 150, determining the cut out angle, which may not be perpendicular to the direction of the sidewall 12, 14, if the strut 20, 22 intersects the sidewall 12, 14 at a curve.

Once all of the piece shapes have been determined from the curved baffle 10 design, the program can optimize a cutting and scoring strategy at step 160 to minimize waste of the curved baffle 10 material. In doing so, the program will shift the different pieces into a location on a board so that the CNC machine will cut out the pieces with the least amount of waste.

Finally, at step 170, the program will send the information to the CNC machine for cutting out the pieces. The pieces include the first sidewall 12, the second sidewall 14, the top spine 16, the bottom spine 18, the multiple struts 20, 22, and the covers 38, 42, 44, although the covers may be a thinner material to be cut from a different piece of material. Once the pieces are cut to size, the acoustic curved baffle 10 can be assembled. The program ends at step 180.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment.

Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional. Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A ceiling baffle comprising:

a first sidewall formed from a felt material and comprising a first surface and a second surface opposite the first surface, the first surface of the first sidewall having a plurality of first sidewall kerfs and the second surface of the first sidewall being free of kerfs;

a second sidewall formed from the felt material and comprising a first surface and a second surface opposite the first surface, the second sidewall having a plurality of second sidewall kerfs;

wherein at least a majority of the second sidewall kerfs are in the first surface of the second sidewall;

wherein each of the first and second sidewalls is configured to be altered from a flat configuration to a curved configuration; and at least one spine coupled to each of the first and second sidewalls to maintain the first and second sidewalls in the curved configuration with an air gap between the first and second sidewalls.

2. The ceiling baffle according to claim 1 wherein the first sidewall comprises a bottom end and a top end and the second sidewall comprises a bottom end and a top end, wherein each of the plurality of first sidewall kerfs extends from the top end of the first sidewall to the bottom end of the first sidewall, and wherein each of the plurality of second sidewall kerfs extends from the top end of the second sidewall to the bottom end of the second sidewall.

3. The ceiling baffle according to claim 1 wherein the plurality of second sidewall kerfs are located only on the first surface of the second sidewall, the second surface of the second sidewall being free of kerfs.

4. The ceiling baffle according to claim 1 wherein the first and second sidewalls are positioned so that the first surface of the first sidewall faces the first surface of the second sidewall.

5. The ceiling baffle according to claim 4 wherein the second surface of the first sidewall and the second surface of the second sidewall are free of kerfs.

6. The ceiling baffle according to claim 1 further comprising:

the first sidewall comprising a plurality of first sidewall top cutouts;

the second sidewall comprising a plurality of second sidewall top cutouts;

the at least one spine comprising an elongated body having a first side edge and a second side edge opposite the first side edge, a plurality of first spine struts protruding from the first side edge, and a plurality of second spine struts protruding from the second side edge, and wherein each of the plurality of first spine struts nests within one of the plurality of first sidewall top cutouts and each of the plurality of second spine struts nests within one of the plurality of second sidewall top cutouts.

7. The ceiling baffle according to claim 1 wherein the at least one spine comprises:

a top spine coupled to top portions of the first and second sidewalls; and a bottom spine coupled to bottom portions of the first and second sidewalls.

8. The ceiling baffle according to claim 7 further comprising:

the top spine comprising a plurality of top spine struts that nests within top cutouts formed into the first and second sidewalls; and the bottom spine comprising a plurality of bottom spine struts that nest within bottom cutouts formed into the first and second sidewalls.

9. The ceiling baffle according to claim 1 wherein the at least one spine is formed from the felt material.

10. The ceiling baffle according to claim 1 further comprising installation hardware coupled to the at least one spine, the installation hardware configured to be coupled to hanging cables that are attached to a ceiling structure to hang the ceiling baffle from the ceiling structure.

11. The ceiling baffle according to claim 1 wherein the at least one spine has a curved shape.

12. The ceiling baffle according to claim 1 wherein the at least one spine comprises a first side edge and a second side edge, each of the first and second side edges comprising one or more concave portions and one or more convex portions.

13. A ceiling baffle comprising:

a first sidewall comprising a first surface and a second surface opposite the first surface, a plurality of first sidewall kerfs formed into the first surface of the first sidewall, the second surface of the first sidewall being free of kerfs;

a second sidewall comprising a first surface and a second surface opposite the first surface, a plurality of second sidewall kerfs formed into the first surface of the second sidewall, the second surface of the second sidewall being free of kerfs;

wherein each of the first and second sidewalls is configured to be altered from a flat configuration to a curved configuration; and at least one spine coupled to each of the first and second sidewalls to maintain the first and second sidewalls in the curved configuration with an air gap between the first and second sidewalls, wherein the at least one spine comprises:

a top spine coupled to top portions of the first and second sidewalls;

a bottom spine coupled to bottom portions of the first and second sidewalls; and at least one strut coupled to a cutout in the first sidewall and a cutout in the second sidewall.

14. The ceiling baffle according to claim 13 wherein each of the first and second sidewalls is formed from a felt material.

15. The ceiling baffle according to claim 13 wherein the first and second sidewalls are maintained spaced apart from one another by an air gap.

16. The ceiling baffle according to claim 13 wherein the at least one spine comprises an elongated body having a first side edge and a second side edge opposite the first side edge, each of the first and second side edges having at least one concave portion and at least one convex portion.

17. A ceiling baffle comprising:

a first sidewall comprising a first surface, a second surface opposite the first surface, a top end, and a bottom end, a plurality of first sidewall kerfs formed into the first surface of the first sidewall, each of the plurality of first sidewall kerfs extending from the top end of the first sidewall to the bottom end of the first sidewall;

a second sidewall comprising a first surface, a second surface opposite the first surface, a top end, and a bottom end, a plurality of second sidewall kerfs formed into the first surface of the second sidewall, each of the plurality of second sidewall kerfs extending from the top end of the second sidewall to the bottom end of the second sidewall;

wherein each of the first and second sidewalls is configured to be altered from a flat configuration to a curved configuration; and at least one top spine and at least one bottom spine, the top spine coupled to at least a portion of the first surface of the first sidewall at the top end of the first sidewall and at least a portion of the first surface of the second sidewall at the top end of the second sidewall and the bottom spine coupled to at least a portion of the first surface of the first sidewall at the bottom end of the first sidewall and at least a portion of the first surface of the second sidewall at the bottom end of the second sidewall to maintain the first and second sidewalls in the curved configuration with an air gap between the first and second sidewalls.

18. The ceiling baffle according to claim 17 wherein each of the first sidewall, the second sidewall, and the at least one spine is formed from a felt material.

19. The ceiling baffle according to claim 17 further comprising installation hardware coupled to the at least one spine, the installation hardware configured to be coupled to hanging cables that are attached to a ceiling structure to hang the ceiling baffle from the ceiling structure.

20. The ceiling baffle according to claim 17, further comprising an end cover coupled to the first sidewall and second sidewall.

21. A curved acoustical panel comprising:

a first sidewall formed from a felt material and comprising a first surface sidewall having a plurality of first sidewall kerfs and a second surface opposite the first surface, the second surface of the first sidewall being free of kerfs;

a second sidewall formed from the felt material and comprising a first surface and a second surface opposite the first surface, the second sidewall having a plurality of second sidewall kerfs;

wherein at least a majority of the second sidewall kerfs are in the first surface of the second sidewall;

wherein each of the first and second sidewalls is configured to be altered from a flat configuration to a curved configuration; and at least one spine coupled to each of the first and second sidewalls to maintain the first and second sidewalls in the curved configuration with an air gap between the first and second sidewalls.

* * * * *